US010629172B1

(12) United States Patent
Alexander

(10) Patent No.: US 10,629,172 B1
(45) Date of Patent: Apr. 21, 2020

(54) DRUM BEATER

(71) Applicant: Keith Alexander, Canandaigua, NY (US)

(72) Inventor: Keith Alexander, Canandaigua, NY (US)

( * ) Notice: Subject to any disclaimer, the term of this patent is extended or adjusted under 35 U.S.C. 154(b) by 0 days.

(21) Appl. No.: 16/537,728

(22) Filed: Aug. 12, 2019

(51) Int. Cl.
*G10D 13/11* (2020.01)
*G10D 13/06* (2020.01)

(52) U.S. Cl.
CPC ..... *G10D 13/11* (2020.02); *G10D 13/06* (2013.01)

(58) Field of Classification Search
CPC ..... G10D 13/11; G10D 13/06
See application file for complete search history.

(56) References Cited

U.S. PATENT DOCUMENTS 833,706 A * 10/1906 Conn ..... G10D 13/11 84/422.2
2,584,554 A * 2/1952 Clayton ..... G10D 13/06 84/170
2,658,421 A * 11/1953 Clayton ..... G10D 13/11 84/422.1
2,822,717 A * 2/1958 Slawienski ..... G10D 13/11 84/422.1
3,125,921 A * 3/1964 Korosh ..... G10D 13/11 84/422.1
4,644,842 A * 2/1987 Aluisi ..... G10D 13/11 84/422.1
9,837,057 B1 * 12/2017 Jespersen ..... G10D 13/12
2019/0272809 A1 * 9/2019 Lenz ..... G10D 13/06

* cited by examiner

*Primary Examiner* — Robert W Horn
(74) *Attorney, Agent, or Firm* — Sanchelima & Associates, P.A.; Christian Sanchelima; Jesus Sanchelima

(57) ABSTRACT

A drum beater including a hollow housing and loose fill material to generate a rattle sound upon striking a drum is disclosed herein. A user can customize the sound and loudness of the generated rattle or sound by changing the size, shape, quantity, materials, or combinations thereof of the hollow housing. The user can further customize the sound and loudness that they wish to create by also changing the size, shape, material, amounts or combinations thereof of the loose fill material. The drum beater also includes a rod to mount the drum beater to a drum foot pedal to control the drum beater while playing the drums. Optionally, the drum beater includes a pad mounted thereon, which changes the way the rattle sounds. The user, such as a musician, is free to express their creativity by how much can be varied in order to generate different sounds and rattles.

12 Claims, 3 Drawing Sheets

DRUM BEATER

BACKGROUND OF THE INVENTION

1. Field of the Invention

The present invention relates to a drum beater with a shaker and, more particularly, to a drum beater with a shaker that is operated by a bass drum foot peddle which imparts a rattle sound when the bass drum beater strikes a drum.

2. Description of the Related Art

Several designs for bass drum beaters have been designed in the past. None of them, however, include a bass drum beater that includes a shaker which imparts a rattle sound once the bass drum beater has struck a drum. There is a new for artist, such as musical artist, to express their creativity. They learn to play different instruments and each individual has a different style for playing their instruments to generate sounds and music as they desire. It is always best for the artist to have more options to express their creativity with varying sounds. Hence, there is a need for a drum beater system that can be fully customized to generate various distinct sounds as per the desires of the user or artist in order for the artist to fully express their creativity.

Applicant believes that a related reference corresponds to U.S. Pat. No. 4,644,842 issued to Alan L. Aluisi for Compound Drum Beater. Aluisi discloses a drum beater assembly for striking a bass drum or the like comprising a support base for supporting various beater assembly components. It includes a rotatable shaft journaled to the support base for providing oscillatory rotational movement in two directions. A foot pedal pivotally mounted on the support base and operably linked to the rotatable shaft for rotating the rotatable shaft in one direction in response to downward pressure on the foot pedal. There is a first beater means operably associated with the rotatable shaft for striking an adjacently positioned drum head a first strike in response to initial downward movement of the foot pedal. Then a second beater operably associated with the rotatable shaft means for striking the adjacently positioned drum head a second strike closely spaced in time with the first strike in response to continued downward movement of the foot pedal. However, it differs from the present invention because the Aluisi reference rotates to strike the drum and it further does not make a rattle sound when the strike on the drum takes place. The present invention serves both as a drum bass beater and a rattle all at once. It results in more sounds for musicians to make when they are making music. There is further less moving part in the present invention thereby making it more durable.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a drum beater to be operable by a bass drum foot pedal.

It is another object of this invention to provide a drum beater comprising a hollow housing which is filled with loose fill material which imparts a rattle sound when the bass drum beater strikes a drum.

It is still another object of the present invention to provide a bass drum beater that is durable.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
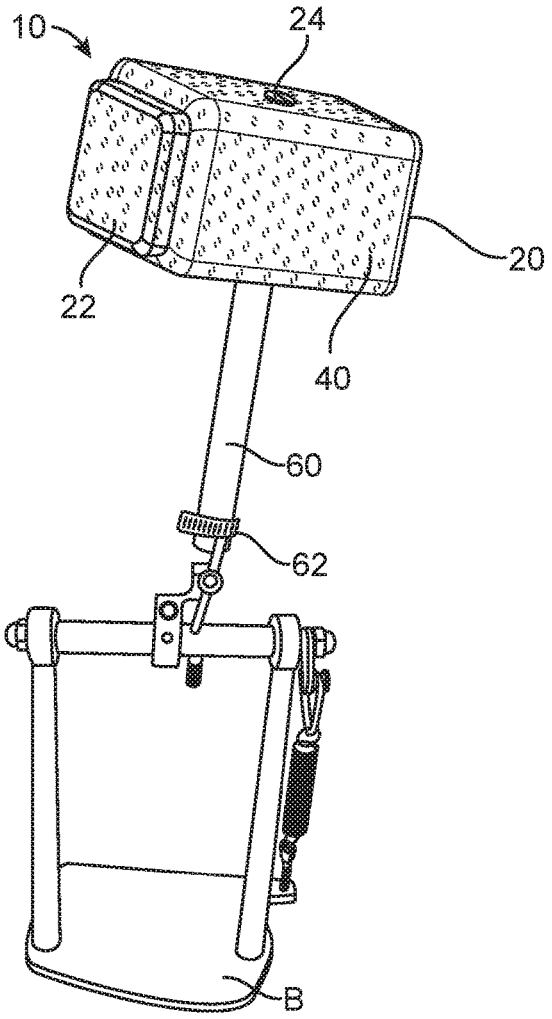
FIG. 1 represents an isometric view of the present invention.

Referring now to the drawings, where the present invention is generally referred to with numeral 10, it can be observed that it, drum beater 10, basically includes a hollow housing 20, a loose fill material 40, and a rod 60.

Figure 4:
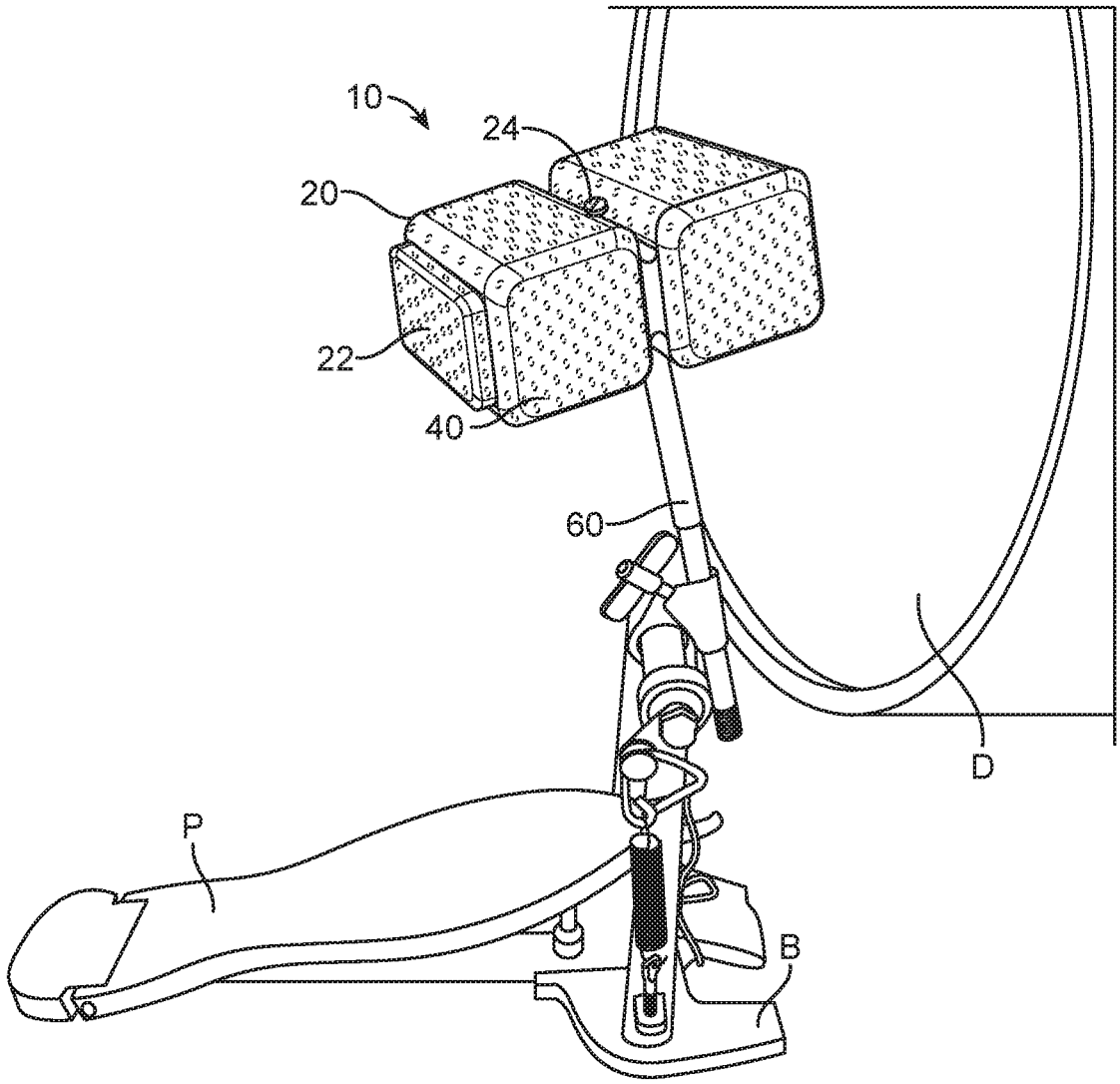
FIG. 4 is a representation of an alternate embodiment of the present invention which may produce more sound.

Referring to FIG. 1 drum beater 10 is seen in an isometric view. It can be seen that drum beater 10 is mounted to a base B. It can be seen that drum beater 10, preferably for a bass drum, includes hollow housing 20. Hollow housing 20 is preferably elongated and rectangular shaped. However, virtually any other shape may be suitable for hollow housing 20. The different shapes would change the sound produced as drum beater 10 strikes a drum D as different amounts of surface area would make contact with drum D depending on the shape of drum beater 10. Hollow housing 20 is preferably made of plastic, but nonetheless other materials such as metal, rubber, felt, wood, cotton or combinations thereof may be suitable. The material used would change the sound that is made once drum beater 10 strikes drum D. Hollow housing 20 is preferably hollow in order to receive loose fill material 40 therein. The hollow interior of hollow housing 20 may alternatively only be partially hollow as to modify the sound produced by use of the present invention. In an alternative embodiment, the interior of hollow housing may be accessible. In order to access the interior of hollow housing 20, a plug 24 may be used. Plug 24 is removable from hollow housing 20. Upon removal of plug 24, user may change loose fill material 40 to be used, which in turn changes to sounds generated by the present invention. Once the desired loose fill material 40 has be inserted into hollow housing 20 then plug 24 is put back in place. Plug 24 may be threaded meaning that plug 24 may be screwed into place or upon removal thereof. In an alternate embodiment, as seen in FIG. 4, there may be a number of hollow housing 20. An increase in the number of hollow housing 20 means that there is also an increase in the amount of loose fill material 40 that can be held. Which of course results in the rattle sound being altered. At least one hollow housing 20 will be suitable, the more sound the user wishes the more of hollow housing 20 may be used. Loose fill material 40 imparts a rattle sound when the drum beater 10 strikes drum D. So, in addition to the sound produced by the drum beater 10 striking drum D, simultaneously the loose filling material 40 moving about hollow housing 20 would also generate a sound. Sound may be produced from loose fill material 40 colliding with one another, from colliding with hollow housing 20 or combinations thereof. Much to the likes of a rattle generated by maracas being shaken, for example. Loose fill material 40 may vary in size, depending on the sounds a user desires to create. In an alternate embodiment, loose fill material 40 may all be the same size or in another alternate embodiment loose fill material 40 may all be of various sizes. Loose fill material 40 may be made of virtually any material, depending on the desired sounds a user would like to generate. More dense and harder materials would create louder sounds. While softer materials would generate less noise. It can be appreciated that the sounds generated may be customized per the needs of a user as they manipulate the materials, size and amounts of loose fill material 40 found inside of hollow housing 20. Lastly, the size of the drum beater 10 and thereby hollow housing 20 may also be changed depending on the needs of a user. A larger drum beater 10 would generate louder and stronger sounds as well as also being able to house more of loose fill material 40, which may also result in a louder rattle sound. The user may customize the size of drum beater 10 depending on the sound and loudness of the sounds they may desire to produce or generate. Optionally, attached to hollow housing 20 may be a pad 22, which is the member that would impact the drum D in the embodiment which includes pad 22. In a similar fashion to hollow housing 20, the materials, size and shape of pad 22 may all be customized depending on the sounds the user may want to achieve. The customizable nature of the drum beater 10 allows a user, such as a musician, to fully express and experiment with their creativity. In an alternate embodiment, hollow housing 20 includes a plurality of openings that allow sound such as generated sound to escape therefrom.

Figure 2:
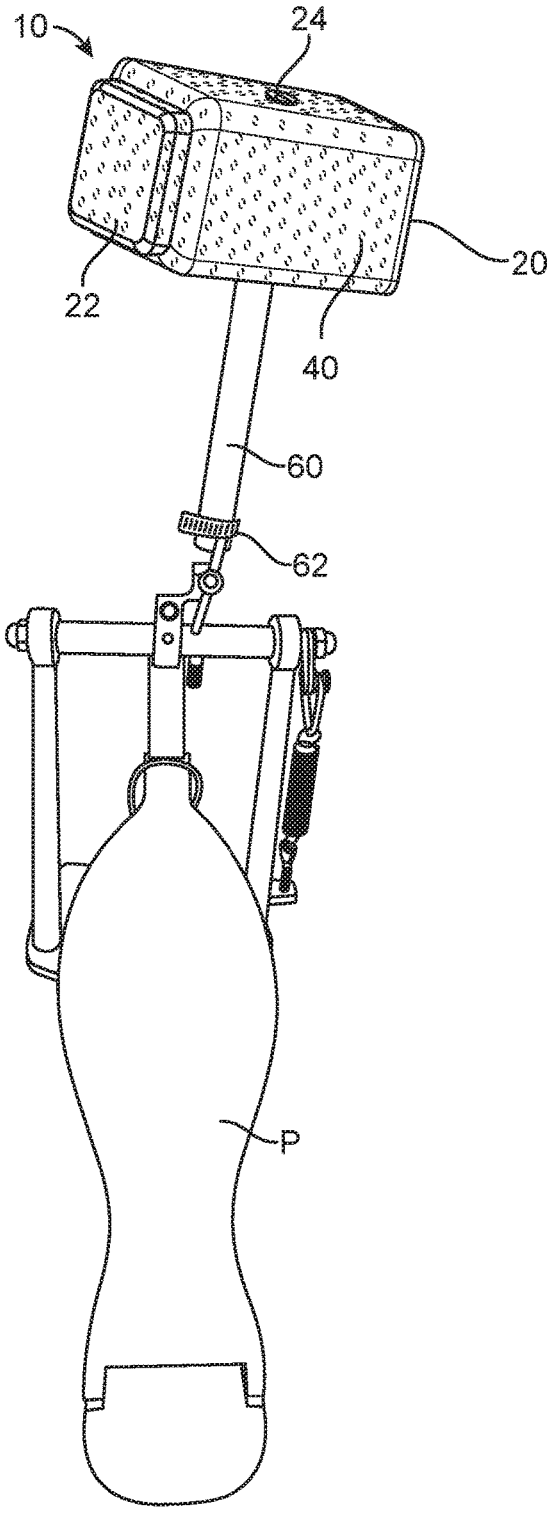
FIG. 2 shows an isometric view of the present invention mounted to a bass drum foot pedal.
Figure 3:
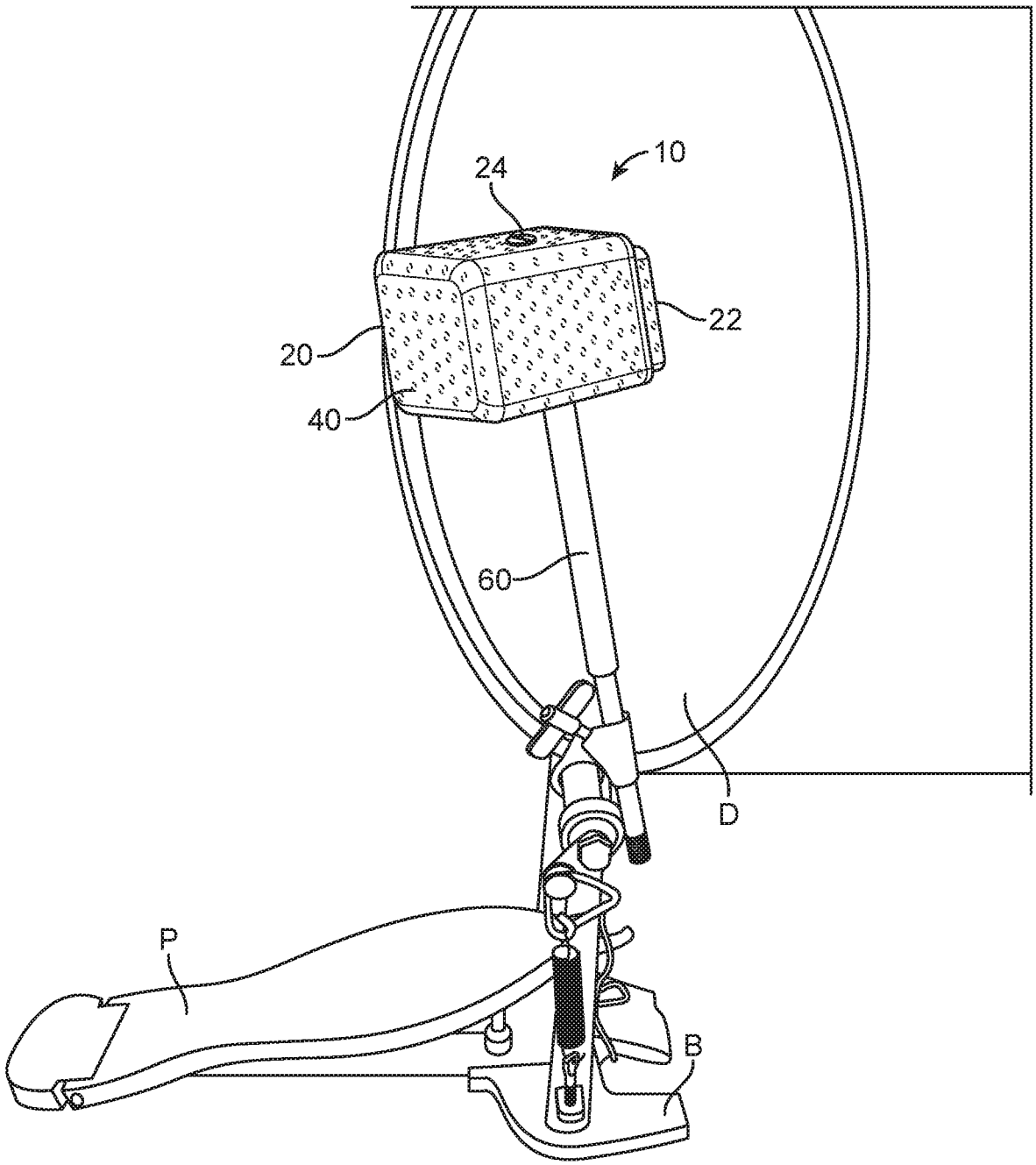
FIG. 3 illustrates the present invention in an operational setting.

As seen in FIG. 2 it can be seen how the drum beater 10 would be used in an operational setting. That is drum beater 10 is mounted to base B which is then mounted to a drum foot pedal P. Drum beater 10 attaches to a drum foot pedal P which is operated to strike a drum D with drum beater 10. There is a rod 60 mounted to hollow housing 20 of drum beater 10. Rod 60 may be mounted to a middle portion of hollow housing 20. Rod 60 may be mounted to a side of hollow housing 20. Rod 60 is mounted to base B on an opposite end and is secured with a fastener 62. In an alternate embodiment, in which there are more than one hollow housing 20, rod 60 may mount in-between the two of hollow housing 20, preferably at a midpoint of the two or more of hollow housing 20. In such an alternate embodiment rod 60 in between two of hollow housing 20 may be secured by fastener 62 to base B, for example. Other means such as by a nut may also be suitable. It should be understood that the location of where rod 60 mounts to on hollow housing 20 may be nearly anywhere on hollow housing 20. Nonetheless, it is preferred that rod 60 mounts to a midpoint of hollow housing 20 either at the side or the underneath hollow housing 20. Rod 60 mounts to a drum foot pedal P by means known in the art. Drum beater 10 may be removably attached to rod 60. Alternatively, rod 60 and drum beater 10 may be fixedly attached. FIG. 3 illustrates drum beater 10 in an operational setting, that is drum beater 10 is mounted to a drum foot pedal P ready for use meaning ready to strike a drum D and rattle upon use. The user playing a drum D can simply step on the drum foot pedal P to make drum beater 10 strike a drum D thereby generating the desired sounds they wish to produce as musicians. There is a sound emitted from the drum beater 10 striking the drum D and also from the drum beater 10 moving. It should be understood that size, shape and materials for rod 60 should not be limiting. They may be changed as per the needs of a user as they may make changes in order to generate different desired sounds. It may also be possible to use the present invention in a manner in which pad 22 faces away from drum D. Thereby a side of hollow housing 20 without pad 22 strikes drum D to generate different and more sounds. All the sounds generated depend on the customizability of the present invention. Many variables can be changed and manipulated to generate many different desired sounds.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a drum beater, comprising:

a. a hollow housing being a shaker;

b. loose fill material, said loose fill material being located inside of said hollow housing;

c. said loose fill material being of a material that produces a sound when said loose fill material collides with one another or said hollow housing;

d. a rod mounted to said hollow housing; and e. said drum beater striking a drum and producing a sound simultaneously using the loose fill material.

2. The system of claim 1, wherein said hollow housing is elongated and rectangular in shape.

3. The system of claim 1, wherein said hollow housing is partially hollow.

4. The system of claim 1, wherein said loose fill material varies in size, shape, material or combinations thereof.

5. The system of claim 1, wherein said loose fill material are all the same size, shape and material.

6. The system of claim 1, wherein said loose fill material are all the same size or shape or material or combinations thereof.

7. The system of claim 1, wherein said drum beater mounts to a drum foot pedal with a fastener adapted to operate said drum beater.

8. The system of claim 1, wherein said rod is mounted to a base on an opposite end, said base is mounted to a drum foot pedal.

9. The system of claim 1, wherein multiple of said hollow housing are attached adapted to create a larger said drum beater.

10. The system of claim 1, wherein said loose fill material are interchangeable.

11. The system of claim 1, wherein said hollow housing includes a plug removably attached to said housing adapted to permit access to an interior of said hollow housing for interchanging of said loose fill material.

12. The system of claim 7, wherein said drum foot pedal is in the shape of shoe sole, said drum foot pedal includes a heel portion and a foot base hingedly mounted thereto, and said hollow housing including a plurality of openings that allow the sound to escape therefrom.

* * * * *